US010730670B2

(12) United States Patent
Lee

(10) Patent No.: US 10,730,670 B2
(45) Date of Patent: Aug. 4, 2020

(54) PACKING BOX

(71) Applicant: Kolor Magnetic (Shenzhen) Co., Ltd., Shenzhen, Guangdong (CN)

(72) Inventor: Ching Mou Lee, Guangdong (CN)

(73) Assignee: Kolor Magnetic (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 16/301,731

(22) PCT Filed: Mar. 10, 2017

(86) PCT No.: PCT/CN2017/076221
§ 371 (c)(1),
(2) Date: Nov. 14, 2018

(87) PCT Pub. No.: WO2018/161334
PCT Pub. Date: Sep. 13, 2018

(65) Prior Publication Data

US 2019/0202607 A1 Jul. 4, 2019

(30) Foreign Application Priority Data

Mar. 7, 2017 (CN) ..... 2017 2 0218202 U

(51) Int. Cl.
*B65D 41/16* (2006.01)
*B65D 43/02* (2006.01)
(Continued)

(52) U.S. Cl.
CPC ..... *B65D 43/0208* (2013.01); *A45C 11/20* (2013.01); *B65D 1/10* (2013.01);
(Continued)

(58) Field of Classification Search
CPC ..... A45C 11/20; B65D 1/10; B65D 21/0222; B65D 45/30; B65D 43/0208;
(Continued)

(56) References Cited

U.S. PATENT DOCUMENTS 7,891,514 B1 * 2/2011 Walsh ..... B65D 43/0212 220/4.21
2009/0173738 A1 * 7/2009 Golota ..... B65D 43/0249 220/265
2013/0175284 A1 * 7/2013 Chen ..... B65D 43/0208 220/780

FOREIGN PATENT DOCUMENTS

CN 2701781 Y 5/2005
CN 101927854 A 12/2010
(Continued)

OTHER PUBLICATIONS

International Search Report of PCT Patent Application No. PCT/CN2017/076221 dated Nov. 30, 2017.

*Primary Examiner* — Elizabeth J Volz

(57) ABSTRACT

A packaging box is provided, which comprising a box body with a top opening and an openable cover connected at a top of the box body. The box body comprises a bottom wall and a side wall connected to a peripheral edge of the bottom wall, and a top of the side wall forms an arc top edge folding outward. The openable cover further comprises a top wall and a fastening part connected to a peripheral edge of the top wall. A convex rib is formed on the fastening part which matches with the arc top edge. The convex rib blocks at a lower edge of the fastening part. A concave recess is respectively arranged on opposite sides of the side wall. The sealing performance as well as the strength of the packaging box is effectively improved, while the structure of the packaging box is convenient for operation.

5 Claims, 5 Drawing Sheets

(51) Int. Cl.

| | |
|---|---|
| ***B65D 1/10*** | (2006.01) |
| ***B65D 45/30*** | (2006.01) |
| ***B65D 21/02*** | (2006.01) |
| ***A45C 11/20*** | (2006.01) |

(52) U.S. Cl.
CPC ..... *B65D 21/0222* (2013.01); *B65D 45/30* (2013.01); *B65D 2543/0062* (2013.01); *B65D 2543/00092* (2013.01); *B65D 2543/00194* (2013.01); *B65D 2543/00398* (2013.01); *B65D 2543/00416* (2013.01); *B65D 2543/00509* (2013.01); *B65D 2543/00648* (2013.01); *B65D 2543/00842* (2013.01)

(58) Field of Classification Search
CPC .. B65D 2543/0092; B65D 2543/00194; B65D 2543/00398; B65D 2543/00416; B65D 2543/00509; B65D 2543/0062; B65D 2543/00648; B65D 2543/00842
USPC ..... 220/4.21, 780, 790, 315, 675, 796; 229/406
See application file for complete search history.

(56) References Cited

FOREIGN PATENT DOCUMENTS

| | | | |
|---|---|---|---|
| CN | 202890880 | U | 4/2013 |
| CN | 203328136 | U | 12/2013 |
| CN | 203419371 | U | 2/2014 |
| CN | 105398666 | A | 3/2016 |

* cited by examiner

PACKING BOX

TECHNICAL FIELD

The present application relates generally to a packaging field, and more particularly, to a packing box.

BACKGROUND

At present, packaging boxes are commonly used in many occasions, such as food packaging, food taking away or medical material packaging, and so on. As the packing box may be used for packaging food such as rice and dishes, it should be well sealed to avoid accidental opening of the box cover, and prevent the spill of soup to a certain extent. However, the sealing performance of commonly used packing boxes cannot meet such requirements.

When opening the packaging box, the cover edge of the packaging box should be broken off with hands operating upward and arduously at first, and then the cover of the packaging box can be opened upward. During such process, as the structure of the packaging box is not conducive to be operated in such a way, the food or other contents in the packaging box may be spilled out.

In addition, as most of the packaging boxes are disposable, they often have a thin thickness. Accordingly, the thin surrounding walls cannot guarantee the strength, which results in deformation even damage of the packaging boxes when subjecting to the external force.

SUMMARY

The object of the present application is to provide a packaging box with a good sealing performance aiming at the above problem of poor sealing performance of the prior packaging box.

In one aspect, a packaging box is provided, which comprising a box body with a top opening and an openable cover connected at a top of the box body. The box body comprises a bottom wall and a side wall connected to a peripheral edge of the bottom wall, and a top of the side wall forms an arc top edge folding outward. The openable cover further comprises a top wall and a fastening part connected to a peripheral edge of the top wall. A convex rib is formed on the fastening part which matches with the arc top edge. The convex rib blocks at a lower edge of the fastening part.

In the packaging box according to the present application, a concave recess is respectively arranged on opposite sides of the side wall.

In the packaging box according to the present application, the concave recess has a cross section of a trapezoid.

In the packaging box according to the present application, a gripping part extending horizontally outward is arranged on the openable cover.

In the packaging box according to the present application, the arc top edge comprises a first inner side connected with the side wall and extending upward, a first outer side, and a first arc part connected with the first inner side at one end and connected with the first outer side with the other end. The first arc part protrudes upward and the first outer side extends downward from the first arc part.

In the packaging box according to the present application, a step is formed at a connection potion between the first inner side of the arc top edge and the side wall.

In the packaging box according to the present application, the fastening part comprises a second inner side extending upward from the peripheral edge of the top wall, a second outer side, and a second arc part connected with the second inner side at one end and connected with the second outer side with the other end. The second arc part protrudes upward and the second outer side extends downward from the second arc part.

In the packaging box according to the present application, there are a plurality of convex ribs arranged on the second outer side of the fastening part and protruding towards the second inner side.

In the packaging box according to the present application, a ring-shaped protrusion protruding towards the second outer side is formed at a lower end of the second inner side; wherein the ring-shaped protrusion surrounds the second inner side and contacts with the arc top edge of the box body.

In the packaging box according to the present application, a recessed transition part is formed between the top wall and the fastening part, wherein the recessed transition part surrounds the top wall.

By the implementation of the packaging box according to the present application, several advantages can be obtained. The sealing performances as well as the strength of the packaging box are effectively improved, while the structure of the packaging box is convenient for operation.

BRIEF DESCRIPTION OF THE DRAWINGS

The present application is further illustrated combining the embodiments and drawings attached.

DETAILED DESCRIPTION OF THE PREFERRED EMBODIMENT

The structure and operation principle of the self-service device for taking tableware according to the present application are further illustrated with reference to the accompanying drawings and embodiments.

Figure 1:
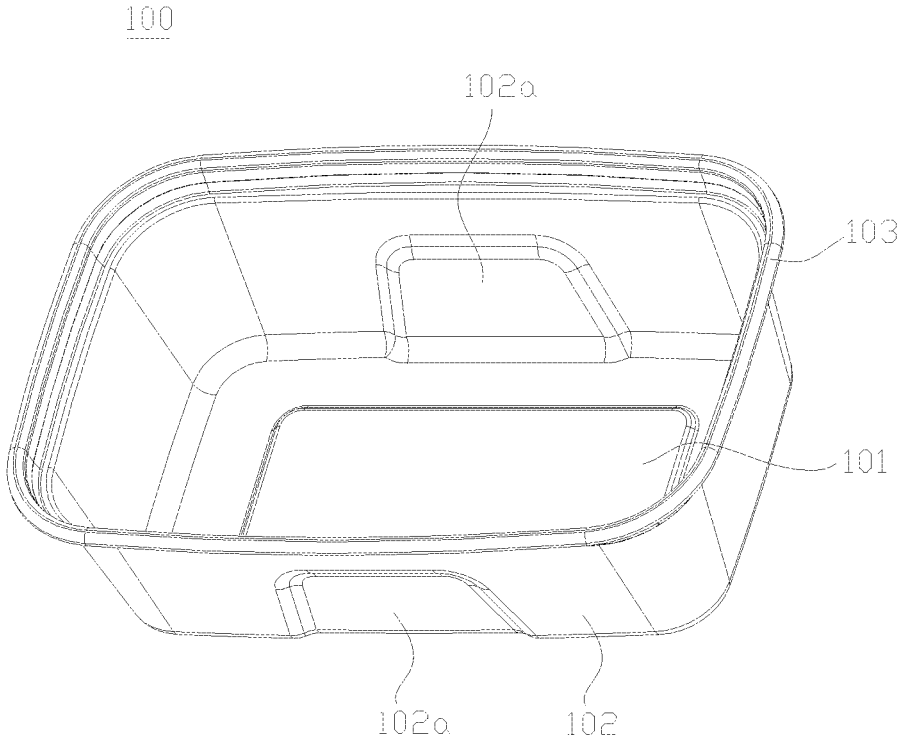
FIG. 1 is a stereogram of the box body of the packaging box according to the present application.
Figure 2A:
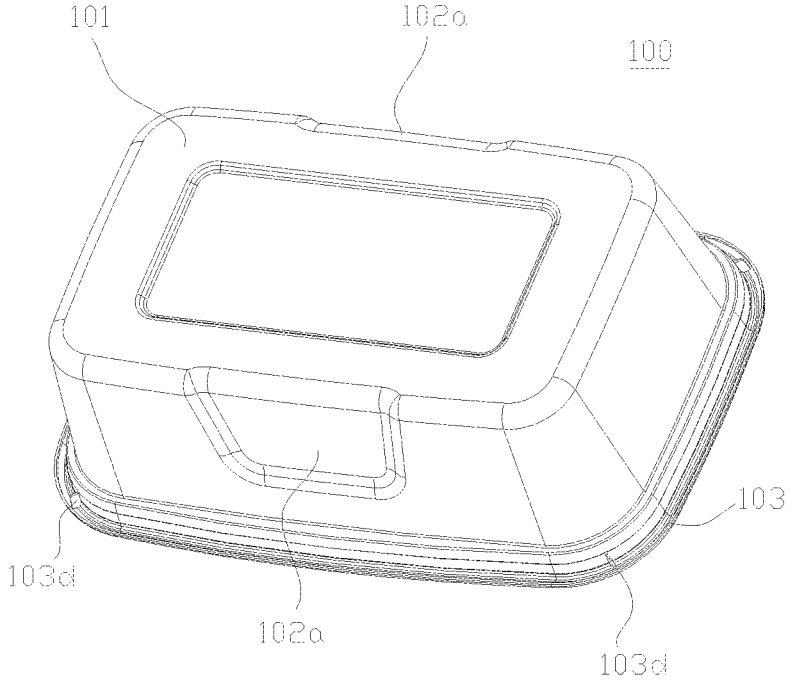
FIG. 2A is another stereogram of the box body of the packaging box according to the present application.
Figure 2B:
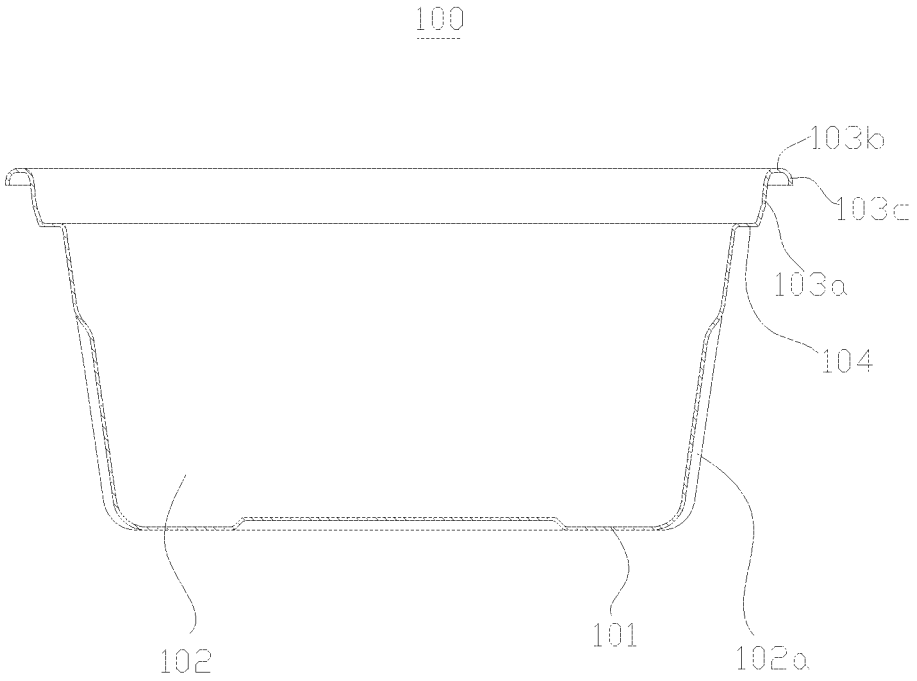
FIG. 2B is a cross-sectional diagram of the box body of the packaging box according to the present application.

FIG. 1 is a stereogram of the box body 100 of the packaging box 10 according to the present application. FIG. 2A is another stereogram of the box body 100 of the packaging box 10 according to the present application. FIG. 2B is a cross-sectional diagram of the box body 100 of the packaging box 10 according to the present application. As shown in FIGS. 1, 2A, 2B, the packaging box 10 comprises a box body 100 with a top opening and an openable cover 200 (shown in FIG. 3) connected at a top of the box body 100.

The box body 100 comprises a bottom wall 101 and a side wall 102 connected to a peripheral edge of the bottom wall 101. The side wall 102 surrounds the bottom wall 101. In the embodiment shown in the figures, the bottom wall 101 has a shape of rectangle with rounded corners, and the side wall 102 is connected to the bottom wall 101 and surrounds the bottom wall 101 to form an approximately cubic packaging box 10. However, the present application is not limited to this, and the bottom wall 101 can also have different shapes, such as a circular shape, and then the packaging box is approximately cylindrical.

The top end of the side wall 102 forms an arc top edge 103 folding outward. The arc top edge 103 comprises a first inner side 103*a* connected with the side wall 102 and extending upward, a first outer side 103*c*, and a first arc part 103*b* connected with the first inner side 103*a* at one end and connected with the first outer side 103*c* with the other end. The first arc part 103*b* protrudes upward and the first outer side 103*c* extends downward from the first arc part 103*b*. In order to improve the strength of the packaging box, a step 104 is formed at a connection potion between the first inner side 103*a* of the arc top edge 103 and the side wall 102. In order to further improve the strength of the arc top edge 103, a convex rib 103*d* extending outward from the first inner side 103*a* and the first arc part 103*b* is arranged on the arc top edge 103.

A concave recess 102*a* is respectively arranged on opposite sides of the side wall 102. For example, the concave recess 102*a* has a cross section of a trapezoid which has a narrower top length and a broader bottom length. Meanwhile the concave recess 102*a* can also have other shapes. Such arrangement of the concave recess 102*a* enables the user to hold the packaging box 10 in a more convenient way. In additional, the concave recess 102*a* can also increase the strength of the box body 100 and reduce the probability of deformation and damage when the box body 100 is subjected to the external force.

Figure 3:
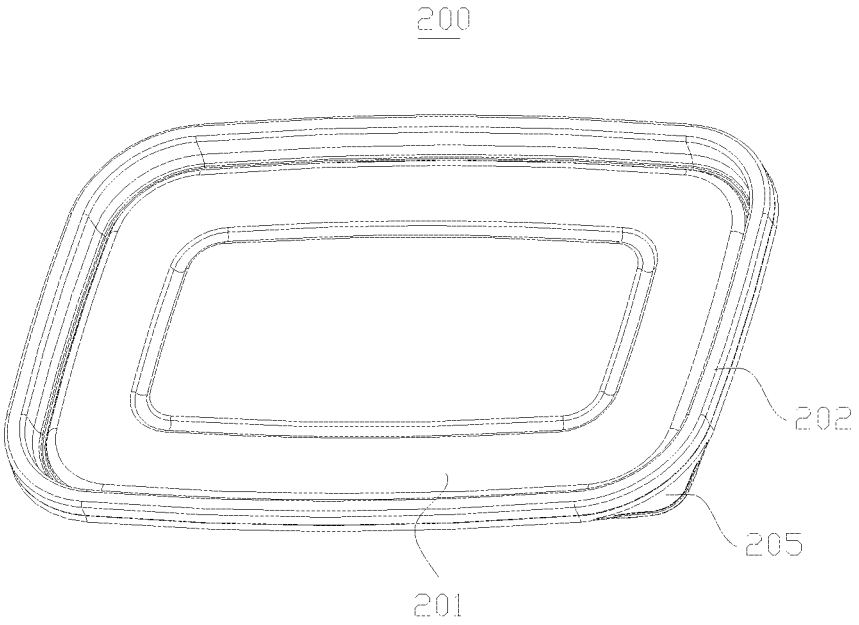
FIG. 3 is a stereogram of the cover of the packaging box according to the present application.
Figure 4:
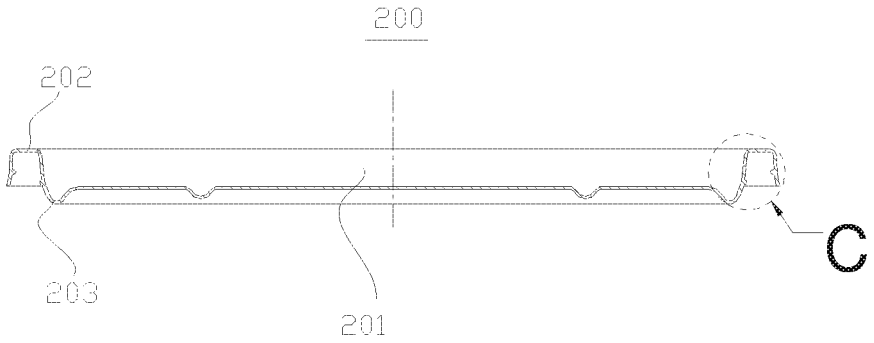
FIG. 4 is a sectional diagram of the cover of the packaging box according to the present application.
Figure 5:
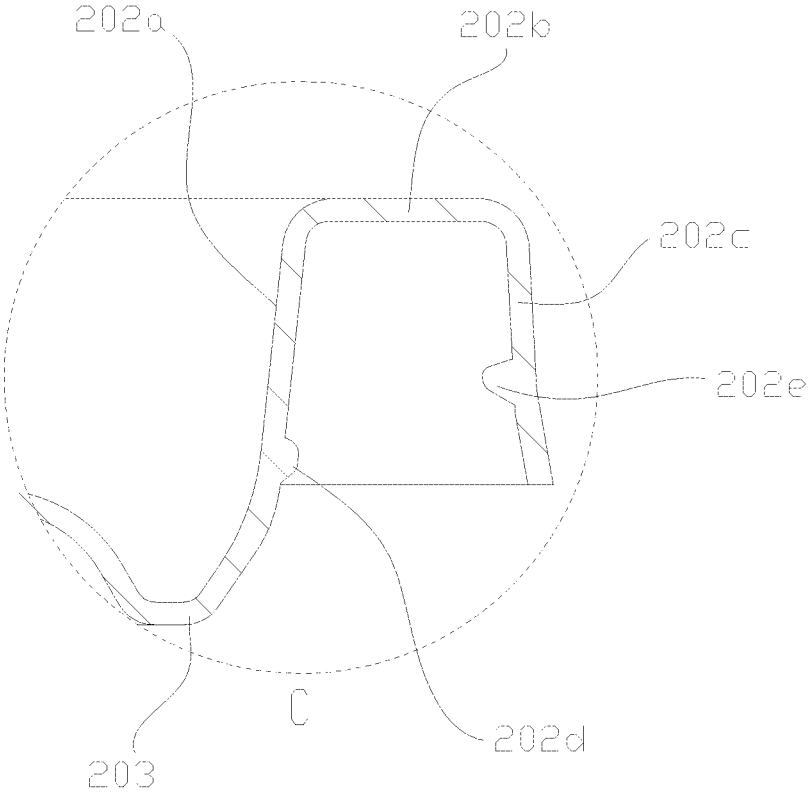
FIG. 5 is a partially enlarged diagram of FIG. 4.

FIG. 3 is a stereogram of the cover 200 of the packaging box 10 according to the present application. FIG. 4 is a sectional diagram of the cover 200 of the packaging box 10 according to the present application. FIG. 5 is a partially enlarged diagram of FIG. 4. As shown in FIGS. 3-5, the openable cover 200 further comprises a top wall 201 and a fastening part 202 connected to a peripheral edge of the top wall 201. The fastening part 202 comprises a second inner side 202*a* extending upward from the peripheral edge of the top wall 201, a second outer side 202*c*, and a second arc part 202*b* connected with the second inner side 202*a* at one end and connected with the second outer side 202*c* with the other end. The second arc part 202*b* protrudes upward and the second outer side 202*c* extends downward from the second arc part 202*b*.

In order to improve the sealing performance of the packaging box 10, a ring-shaped protrusion 202*d* protruding towards the second outer side 202*c* is formed at a lower end of the second inner side 202*a*. The ring-shaped protrusion 202*d* surrounds the second inner side 202*a*. When the fastening part 202 of the cover 200 is fastened on the arc top edge 103 of the box body 100, the ring-shaped protrusion 202*d* contacts with the first inner side 103*a* of the arc top edge 103 of the box body 100, so as to improve the sealing performance of the packaging box 10 (referring FIGS. 6-7).

In order to make the matching between the cover 200 and the box body 100 smooth, a recessed transition part 203 is formed between the top wall 201 and the fastening part 202. The recessed transition part 203 surrounds the top wall 201. The recessed transition part 203 preferably has a downward concave arc structure, and its lowest point is lower than the top wall 201.

The recessed transition part 203 has a function that when the fastening part 202 of the cover 200 is fastened on the arc top edge 103 of the box body 100, the recessed transition part 203 locates at the inner side of the arc top edge 103, which can improve the sealing performance of the packaging box 10.

Figure 6:
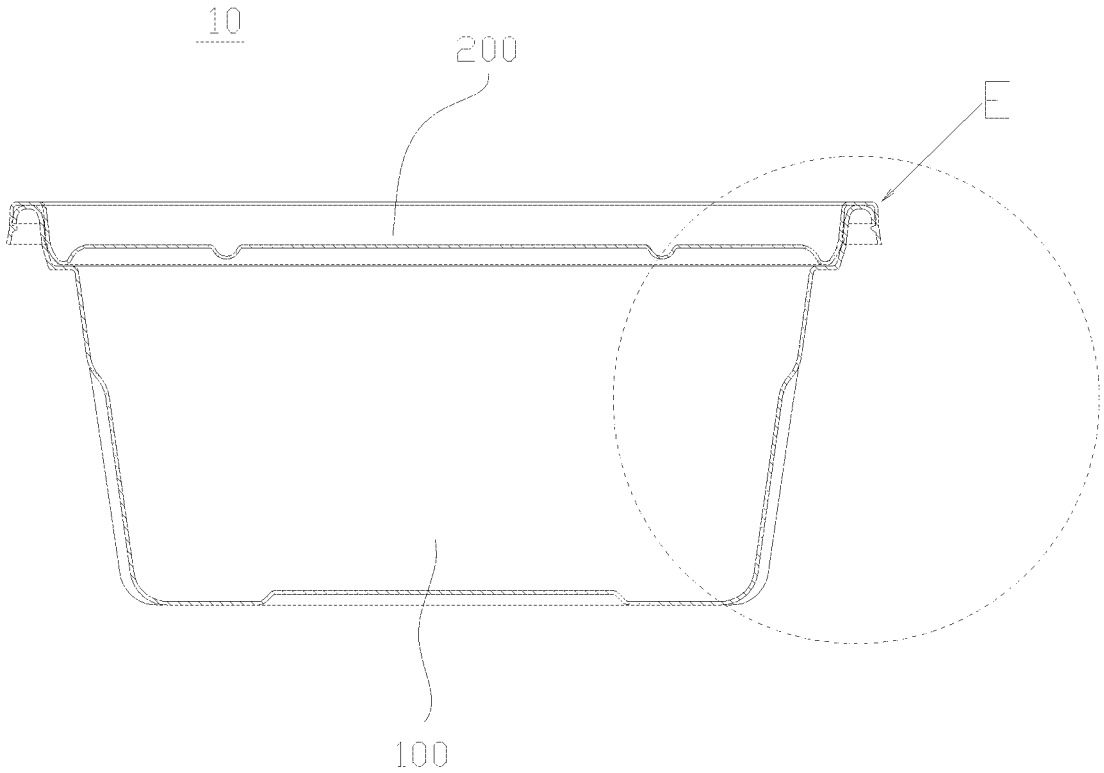
FIG. 6 is a sectional diagram of the packaging box according to the present application.
Figure 7:
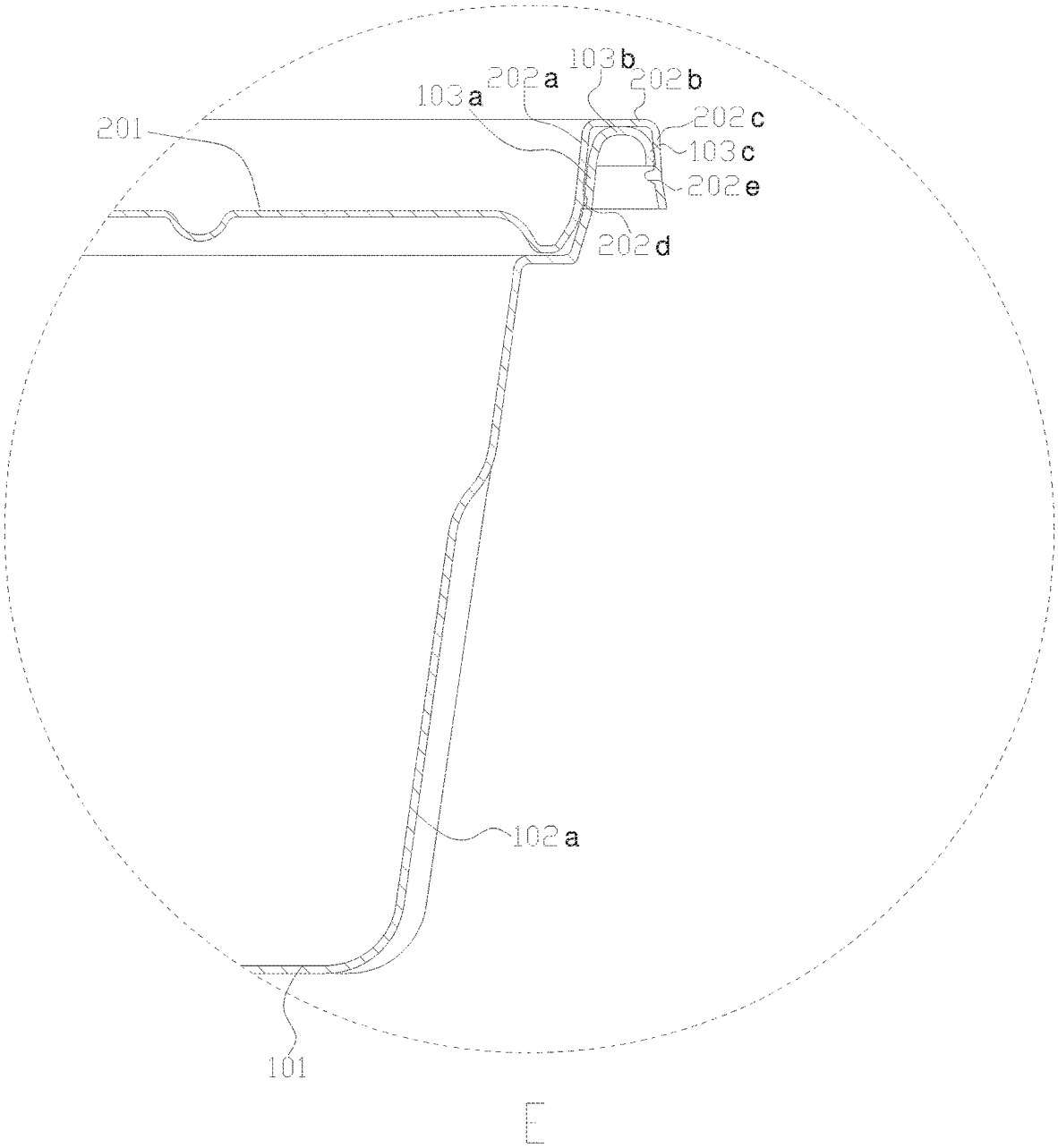
FIG. 7 is a partially enlarged diagram of FIG. 6.

There are a plurality of convex ribs 202*e* arranged on the second outer side 202*c* of the fastening part 202 and protruding towards the second inner side 202*a*. These convex ribs 202*e* are horizontally extended, and can have a semi-cylindrical or other shape. These convex ribs 202*e* can have smooth surfaces facilitate fastening. The distance A between the upper edge of the plurality of convex ribs 202*e* and the second arc part 202*b* of the fastening part 202 is equal to or slightly greater than the corresponding distance between the lower edge of the first outer side 103*c* and the top surface of the first arc part 103*b* of the arc top edge 103. That is to say, when the cover 200 is fastened onto the box body 100, the first outer side 103*c* of the arc top edge 103 would squeeze the convex ribs 202*e* on the fastening part 202, which would slightly deform the second outer side 202*c* of the fastening part 202 outward. When the fastening is in place, the convex ribs 202*e* block at the lower edge of the first outer side 103*c* of the box 100 so that the cover 200 would not fall off easily. As shown in FIGS. 6-7, such structure effectively improves the sealing performance of the packaging box 10.

Back to FIG. 3, a gripping part 205 extending horizontally outward from the second outer side 202*c* is arranged on the openable cover 200. The gripping part 205 can be arc-shaped, such that when the openable cover 200 is opened, the gripping part 205 can be gripped so as to conveniently open the cover 200.

By the implementation of the packaging box according to the present application, several advantages can be obtained. The sealing performance as well as the strength of the packaging box is effectively improved, while the structure of the packaging box is convenient for operation.

The foregoing is a further detailed description of the present application in connection with specific preferred embodiments, and cannot be considered as that the specific implementation of the present application is limited to these illustrations. It will be apparent to those skilled in the art that any various modifications or substitutions may be made to the present application without departing from the spirit of the invention, and such modifications or substitutions should be considered as falling within the scope of the present application.

What is claimed is:

1. A packaging box comprising a box body with a top opening and an openable cover connected at a top of the box body; wherein the box body comprises a bottom wall and a side wall connected to a peripheral edge of the bottom wall, wherein a top of the side wall forms an arc top edge folding outward; wherein the openable cover further comprises a top wall and a fastening part connected to a peripheral edge of the top wall; wherein the arc top edge comprises a first inner side connected with the side wall and extending upward, a first outer side, and a first arc part connected with the first inner side at one end and connected with the first outer side with the other end; wherein the first arc part protrudes upward and the first outer side extends downward from the first arc part;

wherein the fastening part comprises a second inner side extending upward from the peripheral edge of the top wall, a second outer side, and a second arc part connected with the second inner side at one end and connected with the second outer side with the other end; the second arc part protrudes upward and the second outer side extends downward from the second arc part;

a recessed transition part is formed between the top wall and the fastening part; the recessed transition part surrounds the top wall and has a downward concave arc structure, and its lowest point is lower than the top wall;

a plurality of convex ribs are arranged on the second outer side of the fastening part and protruding horizontally towards the second inner side; wherein a distance between the upper edge of the plurality of convex ribs and the second arc part of the fastening part is equal to or slightly greater than a corresponding distance between a lower edge of the first outer side and a top surface of the first arc part of the arc top edge; when the cover is fastened onto the box body, the first outer side of the arc top edge would squeeze the convex ribs on the fastening part, which would slightly deform the second outer side of the fastening part outward; when the fastening is in place, the convex ribs block at the lower edge of the first outer side of the box;

a ring-shaped protrusion protruding towards the second outer side is formed at a lower end of the second inner side.

2. The packaging box according to claim 1, wherein a concave recess is respectively arranged on opposite sides of the side wall.

3. The packaging box according to claim 2, wherein the concave recess has a cross section of a trapezoid.

4. The packaging box according to claim 1, wherein a gripping part extending horizontally outward is arranged on the openable cover.

5. The packaging box according to claim 1, wherein a step is formed at a connection portion between the first inner side of the arc top edge and the side wall.

* * * * *